US007373937B2

(12) United States Patent
Little et al.

(10) Patent No.: US 7,373,937 B2
(45) Date of Patent: May 20, 2008

(54) DRAFT CONTROL SYSTEM AND METHOD FOR HEATING SYSTEMS

(75) Inventors: Robert A. Little, Vancouver (CA); George H. K. Lau, Vancouver (CA); E. Wayne Thurber, Kelowna (CA)

(73) Assignee: FPI Fireplace Products International Ltd., Delta, BC (CA)

( * ) Notice: Subject to any disclaimer, the term of this patent is extended or adjusted under 35 U.S.C. 154(b) by 0 days.

(21) Appl. No.: 10/778,732

(22) Filed: Feb. 13, 2004

(65) Prior Publication Data

US 2004/0226553 A1 Nov. 18, 2004

Related U.S. Application Data

(60) Provisional application No. 60/447,459, filed on Feb. 14, 2003.

(51) Int. Cl.
*F23L 13/00* (2006.01)
*F24C 1/14* (2006.01)

(52) U.S. Cl. ..... 126/286; 126/290; 126/77; 126/80

(58) Field of Classification Search ..... 126/286, 126/285 B, 289, 77, 80, 500, 285 A, 290; 110/163, 147; 431/75
See application file for complete search history.

(56) References Cited

U.S. PATENT DOCUMENTS 3,943,861 A * 3/1976 Astrom et al. ..... 110/182.5
4,264,297 A * 4/1981 Van Berkum ..... 431/76
4,299,554 A * 11/1981 Williams ..... 431/16
4,353,351 A * 10/1982 Cagle ..... 126/193
4,545,363 A * 10/1985 Barchechat et al. .... 126/285 B
4,556,044 A * 12/1985 Barsness et al. ..... 126/77
5,113,843 A * 5/1992 Henry et al. ..... 126/77
6,595,199 B1 * 7/2003 Andersen et al. ..... 126/290

FOREIGN PATENT DOCUMENTS

DE 31 42 394 A 9/1982
EP 0 061 915 A 10/1982
EP 0 076 911 A1 * 4/1983
EP 0 604 388 A 6/1994
EP 0 604 388 A1 * 6/1994
EP 0 971 169 A 1/2000
WO PCT/IB2004/000722 2/2005
WO PCT/IB2004/000722 5/2005

OTHER PUBLICATIONS

PCT International Search Rpt, Jul. 29, 2004.

* cited by examiner

*Primary Examiner*—Josiah C. Cocks
(74) *Attorney, Agent, or Firm*—Snell & Wilmer L.L.P.

(57) ABSTRACT

A draft control system and method can provide for automated control of the air drafting for heating systems. In accordance with an exemplary embodiment, an exemplary draft control system comprises at least one draft plate and a draft plate control system. Draft plate control system can comprise a control unit, one or more input devices, and one or more actuation systems. During operation, the control unit can receive a signal from an input device and use the actuation system to automatically adjust the amount of air intake by controlling movement of one or more draft plates.

11 Claims, 3 Drawing Sheets

DRAFT CONTROL SYSTEM AND METHOD FOR HEATING SYSTEMS

CROSS-REFERENCE TO RELATED APPLICATIONS

This application claims priority to U.S. Provisional Application No. 60/447,459, entitled "Draft Control System and Method" and filed Feb. 14, 2003.

FIELD OF INVENTION

The present invention relates to heating systems. More particularly, the present invention relates to a draft control method and system for controlling the drafting of air within heating systems.

BACKGROUND OF THE INVENTION

For airtight stove appliances used for heating applications, the combustion cycle is controlled by the amount of air flowing into the stoves. The air is required to complete the combustion cycle with a fuel source, with the combustion cycle also influenced by the specific design of the firebox, the type of fuel, and the exhaust system. A basic firebox comprises an airtight box with a door for loading fuel, a manually-operated draft control arrangement to control the pilot, primary, secondary and any other air intakes for combustion, and a flue system for exhaust in order to maximize efficiency and optimize bum time. The draft control arrangement comprises a draft plate covering the opening for the pilot, primary and secondary intakes, and operates by manually pushing and pulling a control lever connected to the draft plate to control the amount of an air opening for the air intakes.

With reference to FIG. 1, a conventional draft control arrangement 100 may comprise a draft box 102 having an air opening 112 configured to allow air intake into a firebox. Air opening 112 is covered by a draft plate 104, the movement of which is controlled by pushing or pulling on a manual control lever 106 to adjust the amount of air intake into the firebox. A mechanical linking system 118 such as a co-axial cable is used to connect manual control lever 106 to draft plate 104.

Such conventional manually-operated draft control arrangements have various drawbacks. For example, if a single plate is used to control all of the air intake openings, due to a linear relationship between the amount of air opening 112 against the supplied air to the firebox via the pilot, primary and secondary intakes, the performance of the stove appliance is limited. In addition, if multiple plates are used for each air intake, the combination and complexity of such a control lever system is not feasible for manual operation, and far too complex for any user to operate. Further, it is impossible to develop a control relationship based on the performance of the stove in terms of burn time, heating capacity and thermostatic control.

SUMMARY OF THE INVENTION

In accordance with various aspects of the present invention, a draft control system and method can provide for automatic control of the air drafting for heating systems, such as stoves and the like. In accordance with an exemplary embodiment, an exemplary draft control system comprises at least one draft plate and a draft plate control system. Draft plate control system can comprise a control unit, one or more input/output devices, and one or more actuation systems. During operation, the control unit can receive an input command signal corresponding to a heating parameter from an input device and control the actuation system to automatically adjust the amount of air intake by controlling movement of one or more draft plates.

BRIEF DESCRIPTION OF THE DRAWINGS

The exemplary embodiments of the present invention will be described in conjunction with the appended drawing figures in which like numerals denote like elements and.

DETAILED DESCRIPTION

The present invention may be described herein in terms of various functional components. It should be appreciated that such functional components may be realized by any number of structural and hardware components configured for operation with electrical, mechanical, gravitational, magnetic, and other actuating forces configured to perform the specified functions. In addition, the present invention may be practiced in any number of heating system contexts and that the stove and firebox systems described herein are merely one exemplary application for the invention. Further, it should be noted that the present invention may employ any number of conventional techniques for transmission or flow of heat and exhaust from the fireboxes, and such general techniques that may be known to those skilled in the art are not described in detail herein. Finally, various components may be suitably coupled together in various manners, including by direct connections or connected together through one or more other components.

Figure 1:
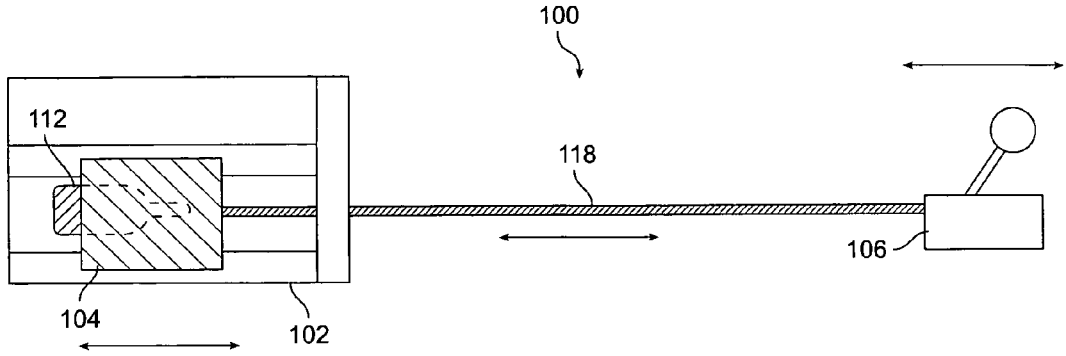
FIG. 1 (PRIOR ART)
FIG. 1 illustrates a conventional manual draft control configuration for manually controlling a damper plate.
Figure 2:
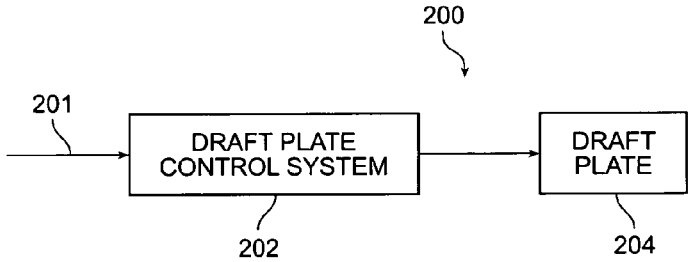
FIG. 2 illustrates a block diagram of an exemplary draft control system in accordance with the present invention.

In accordance with various aspects of the present invention, a draft control system and method can provide for automatic control of the air drafting for heating systems, such as for a heating stove within a firebox. In accordance with an exemplary embodiment, an exemplary draft control system comprises at least one draft plate and a draft plate control system. For example, with reference to FIG. 2, an exemplary draft control system 200 comprises a draft plate control system 202 and a draft plate 204.

Draft plate 204 is coupled to in various manners to draft control system 202. Draft plate 204 may comprise any number of configurations for covering an air opening to a firebox, i.e., draft plate 204 may comprise any device or component actuated upon by which such actuation varies the intake amount of combustion air to a combustion area. By example, such configurations may include any polygonal-shaped or circular-shaped plate, a three-dimensional component such as a block or stopper, or any another single or multi-component mechanical system that may facilitate regulation of the airflow to the combustion area.

Draft plate control system 202 is configured to receive an input command 201 and to automate operation of draft plate 204. Input command 201 comprise a command input signal corresponding to a heating parameter or characteristic, such as request for increased or decreased temperature, airflow, gas emissions and the like, and can be generated and received in various manners, for example from an input device such as a local control pad, a sensor device and/or remote control device. In accordance with an exemplary embodiment, draft plate control system 202 can comprise a control unit, one or more input/output devices, and one or more actuation systems. For example during operation, the control unit can receive an input command signal from an input device and control the actuation system to automatically adjust the amount of air intake by controlling movement of one or more draft plates 204.

Figure 3:
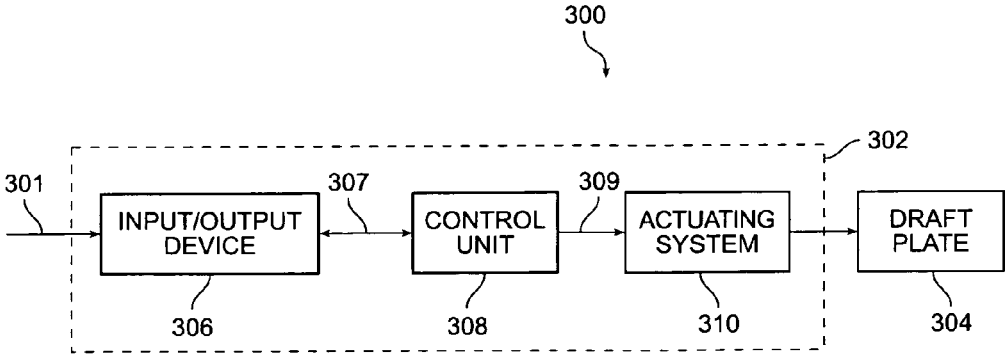
FIG. 3 illustrates a block diagram of an exemplary draft control system in accordance with an exemplary embodiment of the present invention.
Figure 4:
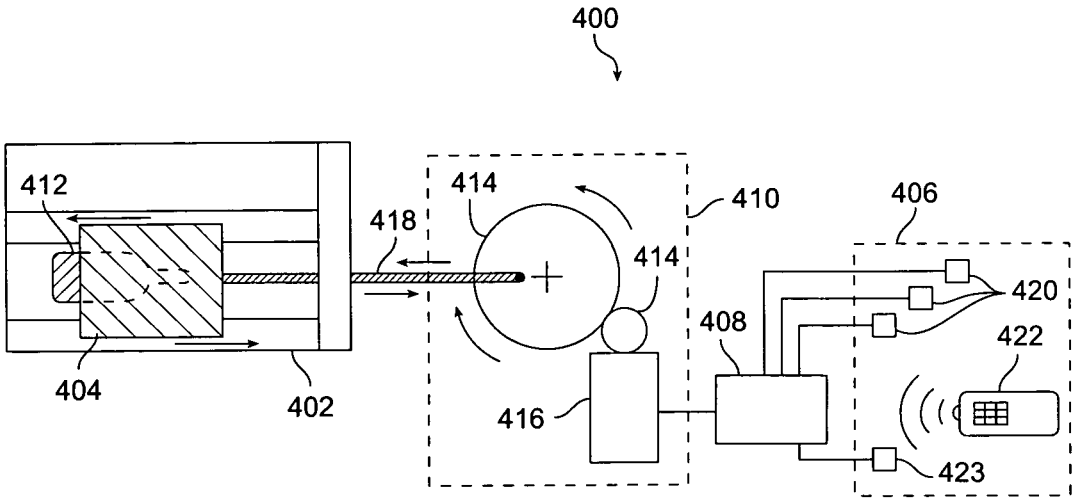
FIG. 4 illustrates an exemplary draft control system in accordance with an exemplary embodiment of the present invention.

For example, with reference to an exemplary embodiment illustrated in FIG. 3, an exemplary draft control system 300 comprises a draft plate control system 302 and a draft plate 304. Draft plate 304 can comprise any conventional configuration for use within a heating system such as stoves to adjust an amount of draft air opening. For example, draft plate 304 can be configured for adjustment of the air opening to feed airflow into pilot, primary and/or secondary intakes to a firebox or other heating stove component. In accordance with an exemplary embodiment, draft plate 304 is configured within a draft box. For example, with reference to FIG. 4, an exemplary draft box 402 can comprise a draft plate 404 configured to adjust an amount of air opening 412. In this example, draft plate 404 can slide along guide rails to increase or decrease air opening 412; however, draft plate 404 can also be adjusted by lifting and lowering, e.g., one or more sides of draft plate 404, to increase or decrease air opening 412. Draft box 402, draft plate 404 and air opening 412 can be configured in any size, shape or orientation within a heating stove or other like appliance.

In accordance with an exemplary embodiment, draft plate control system 302 can comprise an input device 306, a control unit 308, and an actuating system 310. Input device 306 is configured to receive an input signal 301, such as input signal 201 for control system 202, and provide a control signal 307 to control unit 308. Control unit 308 is configured to process control signal 307 to determine if any adjustment of draft plate 304 is required, i.e., any automated or controlled adjustment of the position of draft plate 304 to regulate an air opening. If no adjustment is necessary, draft plate 304 can be maintained in a current position; if however an adjustment is needed, control unit 308 is configured to send an output control signal 309 to actuation system 310 to adjust and reposition draft plate 304 to provide a desired opening.

Input device 306 may comprise any type, number or combination thereof of devices that can be used to accept and/or receive an input command and transmit a command signal to control unit 308. For example, input device 306 can be configured as a control pad and/or as a remote-control device for providing a command signal to control unit 308. Thus, input device 306 may comprise a keyboard, keypad, touch pad or screen, or any other control pad configuration and the like configured to provide command signal 307. In addition, to facilitate regulated adjustment of draft plate 304, one or more input devices 306 may include various types of sensor devices, such as thermostats, tachometer or other position indicators, gas emission measurement devices, or any other sensor device configured to determine a characteristic relating to heating systems, such as temperature, barometric pressure, air flow, gas emissions, and/or position of draft plate 304 relative to an air opening for the firebox. In addition to operating as an input-only device, input devices 306 may also comprise any output display or readout to provide information regarding any characteristic relating to heating systems. Such displays or readouts can be configured separate from or configured within any control pads, remote-control devices and the like.

Input 306 may be coupled to control unit 308 in various manners for carrying signals to and from control unit 308. For example, input device 306 may be configured for direct connection through electrical wiring, or may configured with a wireless or remote transmitter device such as a remote control, a cellular device, a wireless electronic organizer, and the like, or any other methodology to allow for communicating with control unit 308. Thus, in accordance with an exemplary embodiment, a user may remotely send input command signal 307 to control unit 308. For example, a user may operate an input device 306 comprising a local remote control unit to provide a desired setting of temperature, airflow or any other characteristic within the heating stove. As another example, a user driving home from work may decide to set the firebox to operate at a given temperature; thus, input/output device 306 may allow for a user to input a signal by wireless transmission, such as from a cellular phone or other remote transmission device to a local receiver device.

Figure 6:
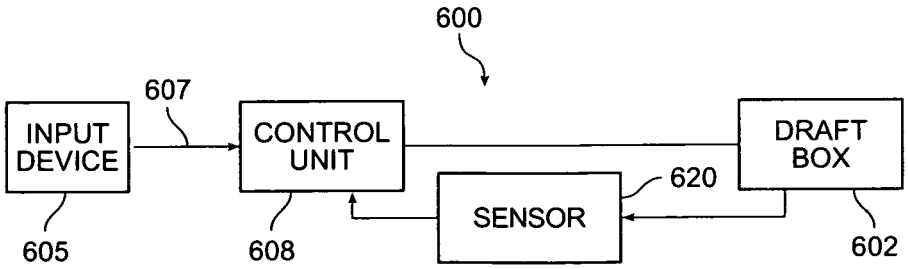
FIG. 6 illustrates a block diagram of an exemplary draft feedback control loop in accordance with an exemplary embodiment of the present invention.

In addition, input device 306 may be configured within an open-loop system, wherein input device 306 merely provides command signal 307 to control unit 308 to facilitate position adjustment of draft plate 304, e.g., such as to merely open and close draft plate 304 in a manner similar to the opening of a variable position sunroof for an automobile. In accordance with another exemplary embodiment, input device 306 can also be configured as a sensor device, such as a thermostatic or other temperature device, airflow device, gas emissions measurement device, a pressure device, and/or a position device configured within a feedback loop to regulate movement of draft plate 304. For example, with momentary reference to FIG. 6, an input device may comprise an input device 605, such as a control pad and/or remote device, configured to provide a command signal 607 to control unit 608, and a sensor 620, such as a thermostatic, airflow and/or position sensor, configured to determine characteristics relating to draft box 602, such as temperature, flow and/or an amount of air opening. Sensor 620 is configured in a closed-loop arrangement to provide a feedback signal to a control unit 608, thus enabling control unit 608 to suitably regulate position of a draft plate with draft box 602 according to information from the feedback signal. While a draft box 602 is illustrated, a sensor 620 could also be configured to determine characteristics relating to a firebox, a heating stove, and/or any external information relating to heating systems, such as the various examples illustrated herein.

In accordance with various other exemplary embodiments, draft plate control system 302 can comprises a plurality of different input/output devices. For example, with momentary reference to FIG. 4, an input device 406 can comprise one or more sensors 420, a localized control pad and/or a remote control unit 422. Thus, not only can input device 306 provide a command signal to a control unit 408 to establish a desired position for a draft plate 404, input device can also comprises at least one sensor 420 to generate feedback information signals to control unit 408 to provide regulated position control. An example may be the use of an airflow sensor 420 configured to monitor the volumetric airflow within a given area of a firebox, e.g., in that it may be desirable to monitor and control the circulation of heat transfer in a given area of a firebox, an airflow sensor 420 may regulate such a condition. Another example may include a motion sensor, wherein it may be preferable to maximize the efficiency of the heating stove and only deliver heating when a given area is occupied, wherein such occupation may be detected by a motion sensor. Moreover, it may be preferable to only deliver adequate heating when a person is occupying a given area, since animals, heavy air flow and the like may inadvertently activate a motion sensor; thus, it may be preferable to use a voice sensor, wherein the detection of an audible signal in a measurable decibel range activates a sensor coupled to control unit 408. Still further, another example may be the use of a sensor 420 to facilitate adjustment of the combustion of a heating stove through control of draft plate 404, depending on the time of day. For example, a light sensor 420 may send a feedback signal to control unit 408 to facilitate adjustment of the position of draft plate 404 depending on the amount of light that is available; i.e. daylight. As yet another example, a timing sensor 420 may be utilized to allow for the increase in the output of the heating stove at a time when people are most likely present in a given area, and to decrease output when they are absent, such as during a typical workday. In yet another example, a weather sensor 420 may be utilized to detect weather conditions external to the room including the heating system. These and other sensor embodiments are merely for exemplary purposes, and any type or number of sensors may be used without affecting the scope of the invention.

For example, in addition to temperature, airflow and gas emission or other environment detection sensors, a draft control system 400 may also be configured with other types of sensors, for example, draft plate position sensors. For example, draft plate 404, which may be configured to be guided along guide rails within a draft box, may also be configured with limit switches, linear potentiometers, or other like devices to confirm the actual position and/or movement of draft plate 404 relative to an air opening 412. Such switches and other devices can be configured in a closed-loop feedback arrangement with control unit 408 to facilitate the positional regulation of draft plate 404 in a closed-loop system. In addition, such position sensors may also be suitably configured within an actuation system 410, such as tachometers and other like devices to monitor gear and/or drive rotational movements to determine positional movement of draft plate 404.

With reference again to FIG. 3, control unit 308 can comprise a computer, microprocessor, and/or any other conventional control device configuring for receiving input signals and for providing control signals and/or output signals. Such control signals and/or output signals can be realized through various algorithms, software codes, output terminals and modules, or any other conventional processes for providing such signals. Control unit 308 can also various types of solid-state or other electronic devices and components for processing information, and/or receiving and providing input and output signals, respectively. Control unit 308 can be configured in various manners proximate to or within a heating system, such as within a housing, enclosure or any other configuration for containing a control unit. In addition, control unit 308 can also be suitably surrounded with various types of insulation materials to enable the various devices and components within control unit 308 to withstand higher temperatures.

Control unit 308 is configured to receive and process one or more input signals received from input device(s) 306 and provide control signals to actuation system 310 for adjustment of draft plate 304. For example, control unit 308 can be configured to receive an "open" or "close" input signal and provide a corresponding control signal to actuation system 310 to suitably open or close draft plate 304 to adjust the amount of draft opening within a firebox. The control signals can be configured to fully open or fully close draft plate 304, or to partially open or close draft plate 304, such as by timing devices, algorithms, position feedback devices, or other like devices.

With additional reference again to FIG. 4, in accordance with an exemplary embodiment, control unit 408 can be configured to receive one or more feedback signals 420 from input device(s) 406, such as temperature or any other types of sensors. For example, control unit 330 can receive information from feedback signals and compare such information to input command signals to determine whether draft plate 404 warrants adjustment. For example, with further momentary reference again to FIG. 6, control unit 608 can receive both a command signal 607 from an input device 605, such as an input display panel or a remote control unit, and a feedback signal 621 from a sensor device 620, such as a temperature sensor. Based on the assessment by a software algorithm or other like process, control unit 608 can determine whether draft plate 304 warrants any further positional adjustment.

In accordance with an exemplary embodiment, control unit 308 can also be configured for providing output signals. For example, with reference to FIG. 4, control unit 408 can be configured with a display panel 423 that provides various operational characteristics, such as, for example, temperature readings from one or more locations, airflow measurements, draft plate position, gas emissions, exterior temperature measurements, programmed temperature or other control settings, indicator lights or signals, or any other information related to operation of a heating system. Such a display can be configured proximate to control unit 408, such as within the same housing, or remotely to control unit 408, e.g., mounted within a separate wall unit and/or within remote control unit 422.

Actuation system 310 is configured for adjustment of draft plate 304 as directed and controlled by control unit 308. Actuation system 310 can be communicatively coupled to control unit 308 in various manners, such as through direct wiring connections, wireless communications, or any other communications methodology, to receive control signals from control unit 308. Actuation system 310 can also comprise various arrangements for providing adjustment of draft plate 304. For example, actuation system 340 may comprise one or more drive boxes, gearboxes, pulleys, drive train and sprocket systems, and/or various linkage systems.

In accordance with an exemplary embodiment, with reference again to FIG. 4, an actuation system 410 can comprise a drive box 416, one or more movement mechanisms 414 such as gearboxes, and a linkage mechanism 418. Drive box 416 is configured to drive movement mechanisms 414 to facilitate operation of linkage mechanism 418. Drive box 416 can comprise any drive mechanism or configuration for receiving a control signal and for driving other components. Movement mechanisms 414 are suitably configured to enable movement of linkage mechanism 418. Movement mechanisms 414 can comprise a single gear or any plurality of gears, sprockets or cogs, and can be arranged in any gear ratio, orientation or any other manner for enabling movement and/or operation of linkage mechanism 418. Linkage mechanism 418 is coupled to draft plate 404 and is configured for adjusting the position of draft plate 404. Linkage mechanism 418 can comprise single or multi-piece cables, wires, chains, rods or any other linking configuration or combination of components for coupling between movement mechanisms 414 and draft plate 404.

In accordance with another exemplary embodiment, in addition to or instead of one or more gears for movement mechanisms 414, actuation system 410 can comprise a drive box 416 configured with a pulley/spool and cable and/or chain configuration. For example, drive box 416 may be coupled to a pulley/spool 414, with pulley/spool further coupled to a linkage mechanism comprising a cable 418. In this example, drive box 416 can suitably turn pulley/spool 414 to wind and unwind cable 418 coupled to draft plate 404, thus adjusting positions of draft plate 404. In accordance with another exemplary embodiment, draft plate 404 may be actuated by a magnetic actuation system, e.g., draft plate 404 and gears or pulleys/spools 414 and linkage mechanism 418 can be magnetically coupled such that movement by gears, pulleys or spools 414 can suitably enable movement of draft plate 404. Accordingly, actuation system 410 can be configured in any manner for receiving control signals from control unit 408 to facilitate movement of draft plate 404.

Figure 5:
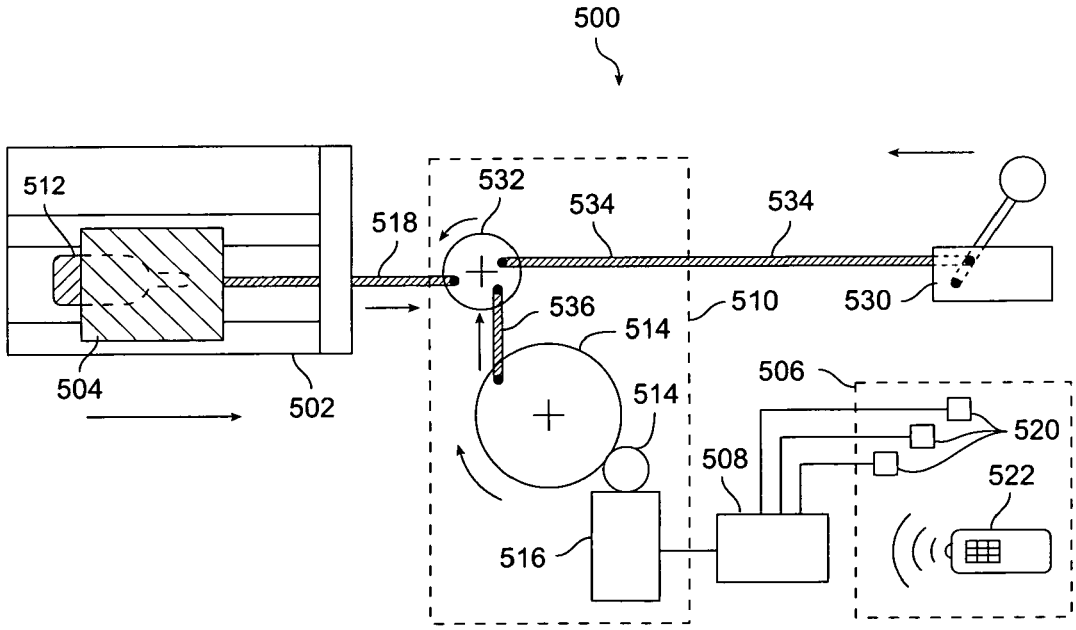
FIG. 5 illustrates an exemplary draft control system comprising a manual override system in accordance with another exemplary embodiment of the present invention.

In accordance with another exemplary embodiment, draft plate 404 may also be manually actuated. With reference to FIG. 5, draft control system 500 may comprise a manual lever 530 coupled to a draft plate 504 through an actuation system 510. For example, manual lever 530 may be coupled to actuation system 510 through a linking mechanism 534, such as cables, wires, chains, rods or any other linking configuration. Actuation system 510 comprises a drive box 516, one or more movement mechanisms 514, and one or more movement mechanisms 532. Movement mechanisms 514 are coupled to movement mechanisms 532 through a linkage mechanism 536 comprising cables, wires, chains, rods or any other linking configuration. Linkage system 534 can be suitably coupled to linkage system 518 through movement mechanism 532 and/or through a removable pin or rod member 535 that can directly link together linkage mechanisms 534 and 518. Accordingly, in addition to automated control of the position of draft plate 504, a person physically manipulating lever 530 can also manually regulate the position of draft plate 504.

Figure 7:
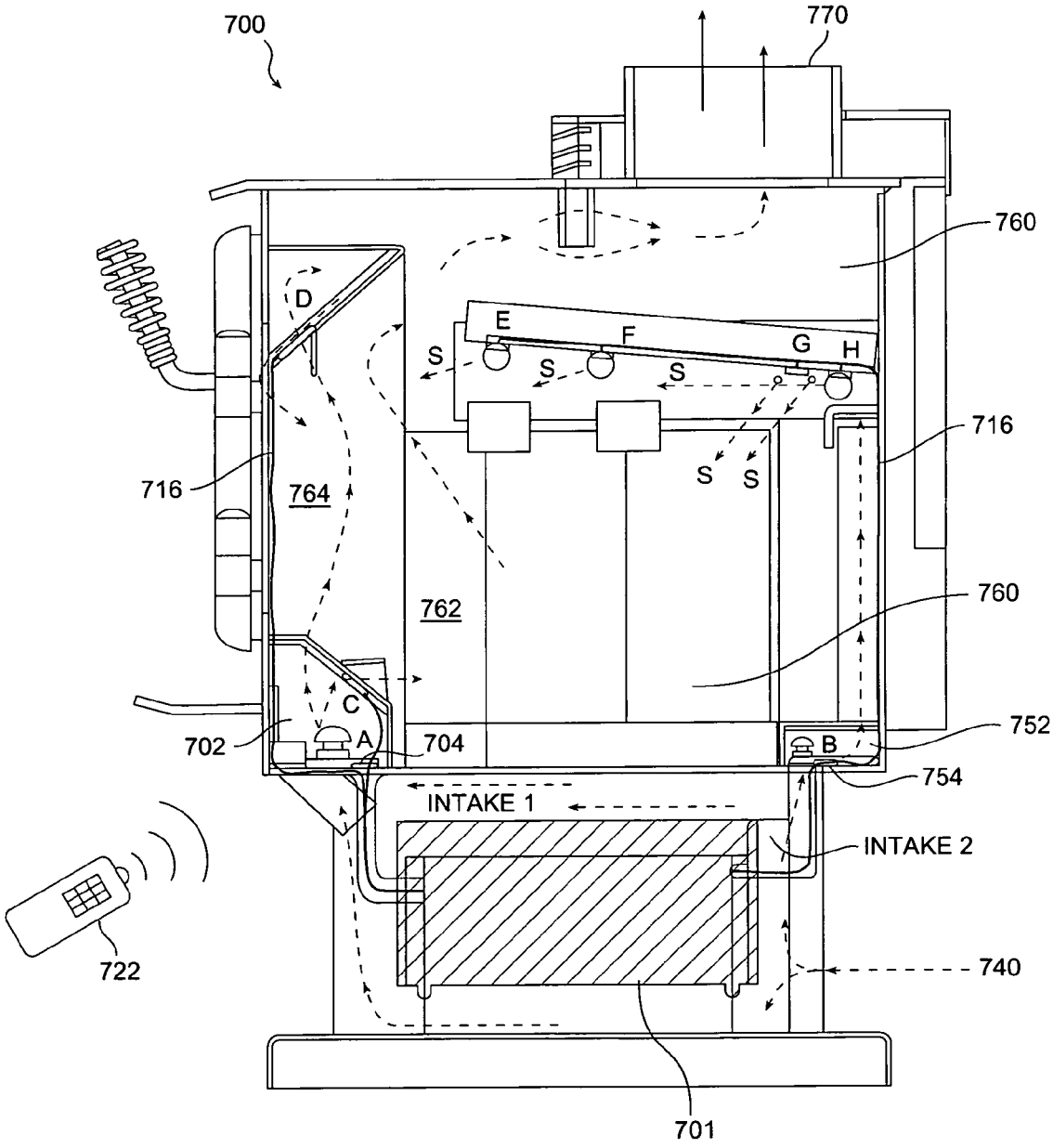
FIG. 7 illustrates an exemplary stove with a firebox having a draft control system in accordance with an exemplary embodiment of the present invention.

With reference to FIG. 7, in accordance with another exemplary embodiment, an exemplary heating stove 700 configured with a draft plate control system 701 is illustrated. Heating stove 700 comprises a substantially airtight firebox 760 configured for combustion. In an exemplary embodiment, firebox 760 is brick-layered, but can comprise any other materials, structures or configurations for combustion use within heating stoves. Heating stove 700 is configured with a main intake air path 740 divided into two sections, an INTAKE 1 and an INTAKE 2. For example, a first section comprising air from main intake 740 at the bottom of heating stove 700 feeds INTAKE 1, the airflow which is controlled by a first draft box 702 and a first draft plate 704 before entering into firebox 760. Through control of position of draft plate 704 by draft plate control system 701, INTAKE 1 can feed pilot air 762 and also channel air up to a primary air intake 764.

A second section comprising air from main intake 740 can also feed an INTAKE 2, which is control by a second draft box 752 and a second draft plate 754. The intake air through INTAKE 2 and draft plate 754 can be suitably channeled into one or more secondary air intakes S, for example, located at points E, F, G and H of tubes configured underneath baffles of firebox 760, before the intake air enters into firebox 760 for combustion. In the exemplary embodiment, draft boxes 702 and 752 are configured within firebox 760, with draft plates 704 and 754 configured in between and with draft ports provided for the exiting of airflow, draft boxes 702 and 752 can also be configured outside firebox 760, with INTAKE 1 and INTAKE 2 coupled to draft boxes 702 and 752, and with draft plates 704 and 754 coupled to firebox 760 to allow for the exiting of airflow.

In accordance with this exemplary embodiment, draft plate control system 701 comprises an enclosure 703 configured for housing a control unit and actuation system. In this exemplary embodiment, enclosure 703 is configured proximate the bottom of heating stove 700; however, enclosure 703 can be suitably configured in various orientations relative to heating stove 700. The control unit can be coupled to a pair of drive boxes within enclosure 703, a first drive box, a first movement mechanism, and a first linkage mechanism configured for adjustment of draft plate 704 and a second drive box, second movement mechanism and a second linkage mechanism configured for adjustment of draft plate 754. In accordance with this exemplary embodiment, the first and second drive boxes can suitably adjust draft plates 704 and 754 at locations A and B through first and second linking mechanisms, such as linking mechanism 418, based upon conditions detected by one or more sensors located at points C, D, E, F, G and/or H, such as temperature, airflow and the like. The signal of each sensor can be sent to the control unit within draft plate control system 701 to adjust the amount of airflow through INTAKE 1 and INTAKE 2 through control of draft plates 704 and 754. Other sensors such as a gas emission sensor, for example, can be configured proximate to an exhaust flue 770.

Various input command signals, such as bum parameters and thermostatic control, can be provided to the control unit by entering of desired parameters, for example through a local control pad coupled to the control unit, and/or by a remote control unit 722. As described earlier, remote control unit 722 can comprise any type of remote transmitter device for providing wireless or remote signals to a control unit. Accordingly, an exemplary draft plate control system 701 and method can provide for manual, automatic and/or regulated control of the drafting for heating stove 700, allowing for an optional burn rate and thermostatic control to be achieved.

Although a separate drive box and/or movement mechanism for draft plates 704 and 754 may be provided, in accordance with other exemplary embodiments, a single drive box and/or movement mechanism can be configured for two or more draft plates, e.g., for draft plates 704 and 754, through various linking mechanisms. In addition, more than two draft plates, as well as additional main, primary, secondary and/or pilot air intakes can be configured within heating stove 700 as a result of the ability to control drafting with multiple draft plates through draft plate control system 701. For example, additional draft plates can be configured at one or more additional locations C, D, E, F and G, such as by additional linkage mechanisms 716. Although not shown, a connection fan for the heat source can also be implemented with heating stove 700, for example, between firebox 760 and a heat shield in the back of heating stove 700, and controlled by the control unit within draft plate control system 701.

The present invention sets forth a draft control system and method that are applicable to various heating system applications. It will be understood that the foregoing description is of exemplary embodiments of the invention, and that the invention is not limited to the specific forms shown. Various modifications may be made in the design and arrangement of the elements set forth herein without departing from the scope of the invention. For example, the location of components to match the design of the heating system, the different types of solid fuel applications, and the variations in one or multiple controls for air intakes into the heating system can be suitably modified, adjusted, and/or re-configured. These and other changes or modifications are intended to be included within the scope of the present invention.

We claim:

1. A draft control system configured for regulating heat within a heating system, said draft control system comprising:

a first draft box coupled to an exterior wall of heating system having a first air opening;

a second draft box coupled to an exterior wall of said heating system having a second air opening, wherein said first and second draft boxes are positioned on opposite sides of said exterior walls to maximize airflow into said heating system;

a substantially flat first draft plate positioned to cover said first air opening, wherein said first air opening provides airflow into said first draft box;

a substantially flat second draft plate positioned to cover said second air opening, wherein said second air opening provides airflow into said second draft box; and a draft plate control system configured for receiving at least one user command signal, wherein said user command signal comprises at least one command signal sent remotely by a user to set said heating system to operate at a given temperature, processing said command signal, establishing a desired position for said first draft plate and said second draft plate to set said heating system to operate at a given temperature, and for controlling movement of said substantially flat first draft plate and said second draft plate such that said first draft plate and said second draft plate moves to adjust said air openings to said first draft box and said second draft box until said temperature set by said user is achieved.

2. The draft control system according to claim 1, wherein said draft plate control system comprises:

at least one input device configured for receiving said command signal;

a control unit for assessing said command signal from said at least one input device and for providing a control signal;

an actuation system configured for adjustment of said first draft plate and said second draft plate upon receiving said control signal.

3. The draft control system according to claim 1, wherein said draft plate control system processes both said user command signal and an input signal from at least one sensor device within said heating system configured in a closed control loop with said control unit to facilitate regulation of position of said first draft plate and said second draft plate.

4. The draft control system according to claim 3, wherein said at least one sensor device comprises at least one of a temperature sensor, an airflow sensor, a gas emission sensor, and a position sensor.

5. The draft control system according to claim 2, wherein said substantially flat first draft plate and said second draft plate are moved by said actuation system by actuating a first draft box, comprising a first movement mechanism, wherein said first movement mechanism comprises at least one of a gear, a pulley, a sprocket, and a spool, coupled to said first draft plate with a linkage mechanism, and by actuating a second draft box comprising a second movement mechanism, wherein said second movement mechanism comprises at least one of a gear, a pulley, a sprocket, and a spool, coupled to said second draft plate with a linkage mechanism, and wherein said linking mechanisms comprise at least one of a cable, a wire, a chain, and a rod.

6. The draft plate control system according to claim 2, wherein said command signal further comprises at least one command signal entered by a user on a local control pad, configured for receiving a plurality of command signals and for providing a plurality of said control signal to set said heating system to operate at a given temperature.

7. The draft plate control system according to claim 1, wherein said command signal sent remotely by a user is sent via a wireless device.

8. The draft control system according to claim 1, wherein said first draft box moves said first draft plate independently of said second draft box moving said second draft plate to maximize airflow and efficient combustion within said heating system.

9. The draft control system according to claim 5, wherein said first draft box moves said first draft plate independently of said second draft box moving said second draft plate to maximize airflow and efficient combustion within said heating system.

10. The wireless device according to claim 7, wherein said wireless device is a cellular phone.

11. A residential combustion stove for providing heat to an area, said stove comprising:

a firebox configured for combustion of fuel to generate heat;

a substantially flat first draft plate configured for adjusting an amount of airflow through a first air opening into said firebox;

a first draft box coupled to an exterior wall of said heating system containing said first draft plate and said first air opening;

a substantially flat second draft plate configured for adjusting an amount of airflow through a second air opening into said firebox;

a second draft box coupled to an exterior wall of said heating system containing said second draft plate and said second air opening, wherein said first and second draft boxes are positioned on opposite sides of said exterior walls to maximize airflow into said stove;

a plurality of internal draft plates configured for adjusting the amount of airflow within said firebox; and a draft plate control system comprising at least one input device configured for receiving a plurality of command signals, wherein at least one command signal is sent remotely by a user from a wireless device to set said heating system to operate at a given temperature, and configured for sending a plurality of control signals based on said plurality of command signals, and an actuation system configured for adjustment of said first draft plate and said second draft plate upon receiving said control signal, wherein said actuation system actuates said first draft box, comprising a first movement mechanism, wherein said first movement mechanism comprises at least one of a gear, a pulley, a sprocket, and a spool, coupled to said first draft plate with a linkage mechanism, and actuates said second draft box comprising a second movement mechanism, wherein said second movement mechanism comprises at least one of a gear, a pulley, a sprocket, and a spool, coupled to said second draft plate with a linkage mechanism, and wherein said linkage mechanisms comprise at least one of a cable, a wire, a chain, and a rod, and further configured adjustment of said plurality of internal draft plates upon receiving said control signal, wherein said actuation system adjusts said substantially flat first and second draft plates to adjust said airflow into and inside said firebox until said temperature set by said user is achieved.

* * * * *